US005848652A

United States Patent [19]

Bennett

[11] Patent Number: 5,848,652

[45] Date of Patent: Dec. 15, 1998

[54] ENGINE FIRE EXTINGUISHMENT SYSTEM

[75] Inventor: Joseph M. Bennett, Huber Heights, Ohio

[73] Assignee: The United States of America as represented by the Secretary of the Air Force, Washington, D.C.

[21] Appl. No.: 934,003

[22] Filed: Aug. 27, 1997

[51] Int. Cl.[6] ..... A62C 3/07

[52] U.S. Cl. ..... 169/62; 169/12

[58] Field of Search ..... 169/62, 12

[56] References Cited

U.S. PATENT DOCUMENTS 4,614,237 9/1986 Colodner et al. ..... 169/12

*Primary Examiner*—Andres Kashnikow
*Assistant Examiner*—Sean P. O'Hanlon
*Attorney, Agent, or Firm*—Bobby D. Scearce; Thomas L. Kundert

[57] ABSTRACT

A fire suppression system for the engine compartment of a vehicle is described which includes a remotely controllable throttle valve disposed within the exhaust duct of the engine for selectively diverting exhaust gases through a bypass duct for mixing with the ventilation airflow for the purpose of reducing the oxygen content in the airflow over the engine below a level which will effectively support combustion.

3 Claims, 2 Drawing Sheets

ENGINE FIRE EXTINGUISHMENT SYSTEM

RIGHT OF THE GOVERNMENT

The invention described herein may be manufactured and used by or for the Government of the United States for all governmental purposes without the payment of any royalty.

BACKGROUND OF THE INVENTION

The present invention relates generally to systems for the prevention or suppression of fires within ventilated machinery spaces, and more particularly to a system using recirculated, oxygen-depleted exhaust gas for fire prevention or suppression within an engine compartment.

Some classes of vehicles have fire extinguishing systems that protect engine compartments against fire damage resulting from engine failure, ruptured fuel lines or other combustible in the engine compartment, or other cause. For Example, a military armored vehicle may require a fire extinguishing system to protect the engine from combat related fire damage, and, because the vehicle may have to continue operation in a threat situation during an engine fire, engine compartment ventilation airflow would exacerbate engine overheat to failure. In existing fire extinguishment systems, the fire may reignite after the extinguishant is exhausted or diluted by the ventilation airflow, and, consequently, such systems have success rates of less than about 24% in actual use. Alternatives to the previously used fire extinguishment material HALON, including HFC-227 ea, dry chemicals and gas generators may also allow reignition under some fire scenarios.

The invention solves or substantially reduces in critical importance problems with prior art systems by providing a fire suppression/prevention system wherein a throttle control valve in the exhaust duct of an engine directs exhaust gases forwardly through a bypass duct for distribution over the engine. The oxygen-depleted exhaust gases will extinguish a fire and prevent reignition while the exhaust gas flow is continued over the engine.

Incorporation of the invention into the engine compartment of a vehicle is accomplished at low cost and is easily and economically maintained and provides continuous fire protection without the need for conventional extinguishant and the associated containment and delivery system.

It is a principal object of the invention to provide a fire suppression system for a vehicle.

It is another object of the invention to provide an improved fire suppression system for the engine compartment of a vehicle.

It is yet another object of the invention to provide a fire suppression system for the engine compartment of a vehicle wherein the engine exhaust is used as the fire extinguishant.

It is another object of the invention to provide a fire suppression system for the engine compartment of a vehicle in preventing reignition of a fire.

It is a further object of the invention to provide a fire suppression system for the engine compartment of a vehicle which permits continuous engine operation and ventilation airflow during extinguishment of the fire.

It is a further object of the invention to provide for the engine compartment of a vehicle a fire suppression system which does not use conventional, environmentally harmful extinguishants.

These and other objects of the invention will become apparent as a detailed description of representative embodiments proceeds.

SUMMARY OF THE INVENTION

In accordance with the foregoing principles and objects of the invention, a fire suppression system for the engine compartment of a vehicle is described which includes a remotely controllable throttle valve disposed within the exhaust duct of the engine for selectively diverting exhaust gases through a bypass duct for mixing with the ventilation airflow for the purpose of reducing the oxygen content in the airflow over the engine below a level which will effectively support combustion.

DESCRIPTION OF THE DRAWINGS

The invention will be more clearly understood from the following detailed description of representative embodiments thereof read in conjunction with the accompanying drawings wherein.

DETAILED DESCRIPTION

Figure 1:
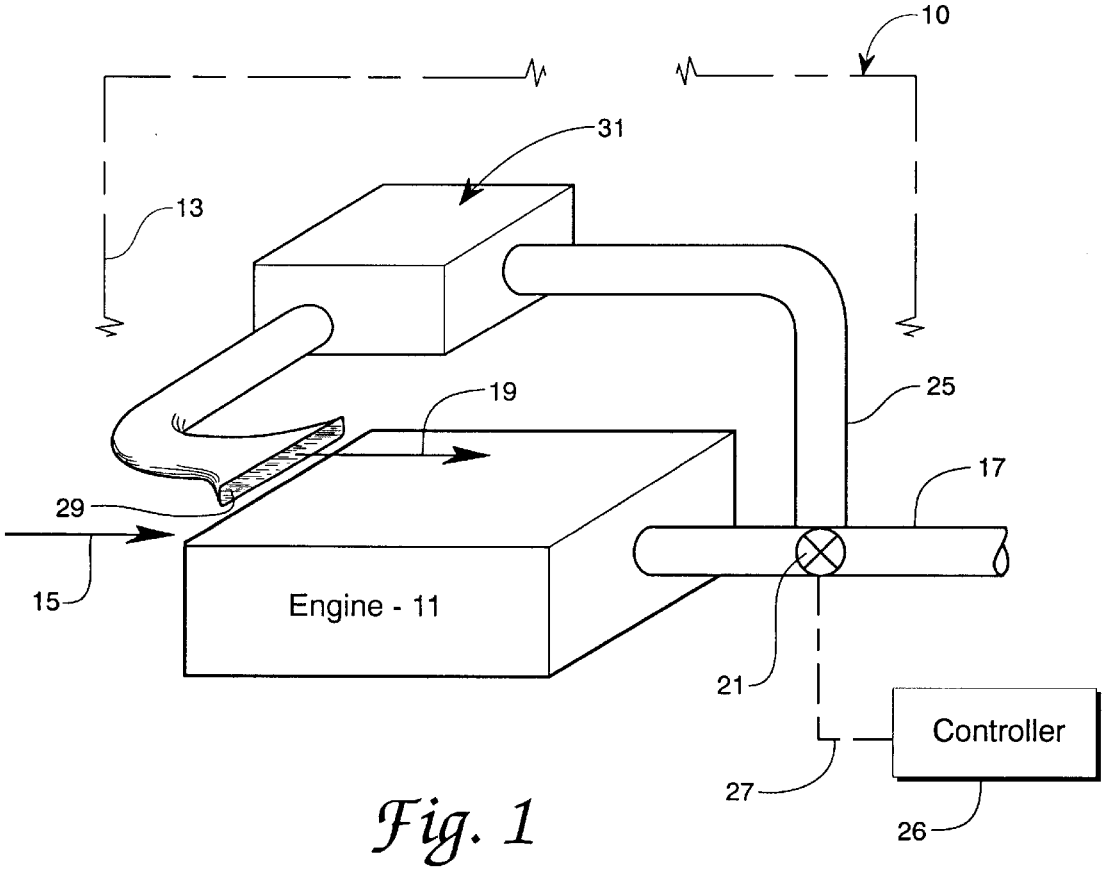
FIG. 1 shows a schematic block diagram of the engine compartment and engine of a vehicle including the fire suppression system of the invention.

Referring now to the drawings, FIG. 1 shows a schematic block diagram of the engine 11 and engine compartment 13 of a vehicle 10 including the fire suppression system of the invention. In accordance with a governing principle of the invention, if the oxygen concentration of the gaseous flow directed over engine 11 is reduced below about 15 volume percent (vol %), fires should not be produced or sustained within compartment 13, and continuous fire protection or extinguishment would result without substantial interruption of ventilation airflow 15 to engine 11. In accordance then with a principal feature of the invention, the exhaust duct 17 of engine 11 may be modified and extended in order to direct oxygen-depleted exhaust gases 19 forwardly into engine compartment 13 for mixing with ventilation airflow 15 for fire prevention or suppression.

In accordance with the teachings of the invention, throttle valve 21, which may be in the form of a controllable damper, butterfly valve, or equivalent valve means occurring to the skilled artisan practicing the invention, is disposed in exhaust duct 17 of engine 11 for selectively diverting all or part of exhaust gases 19 from engine 11 into bypass duct 25. Valve 21 may be controllable by a suitable controller 26 operatively connected by mechanical or electromechanical linkage 27 for manual or remote operation, or may be controllable by fire sensors normally used for activating fire extinguishers in conventional systems. In accordance with these teachings controller 26 may be disposed within the crew or passenger compartment of vehicle 10 (not shown in the drawings) for remote operation. Activation of valve 21 during operation of engine 11 results in diversion of exhaust gases 19 through duct 25 and outlet 29 for mixing with ventilation airflow 15 and distribution over engine 11. Compartment 31 may be disposed within duct 25 adjoining engine compartment 13 for the purpose of diffusing the flow of exhaust gases 19 or of enclosing cooling means for exhaust gases 19 in the form of cooling fins, a heat exchanger, an expansion chamber, filter, or the like. After mixing with ventilation airflow 15 for suppression or prevention of fire, exhaust gases 19 flow rearwardly of engine 11 and vehicle 10 along a flow path normally taken by ventilation airflow 15.

Figure 2:
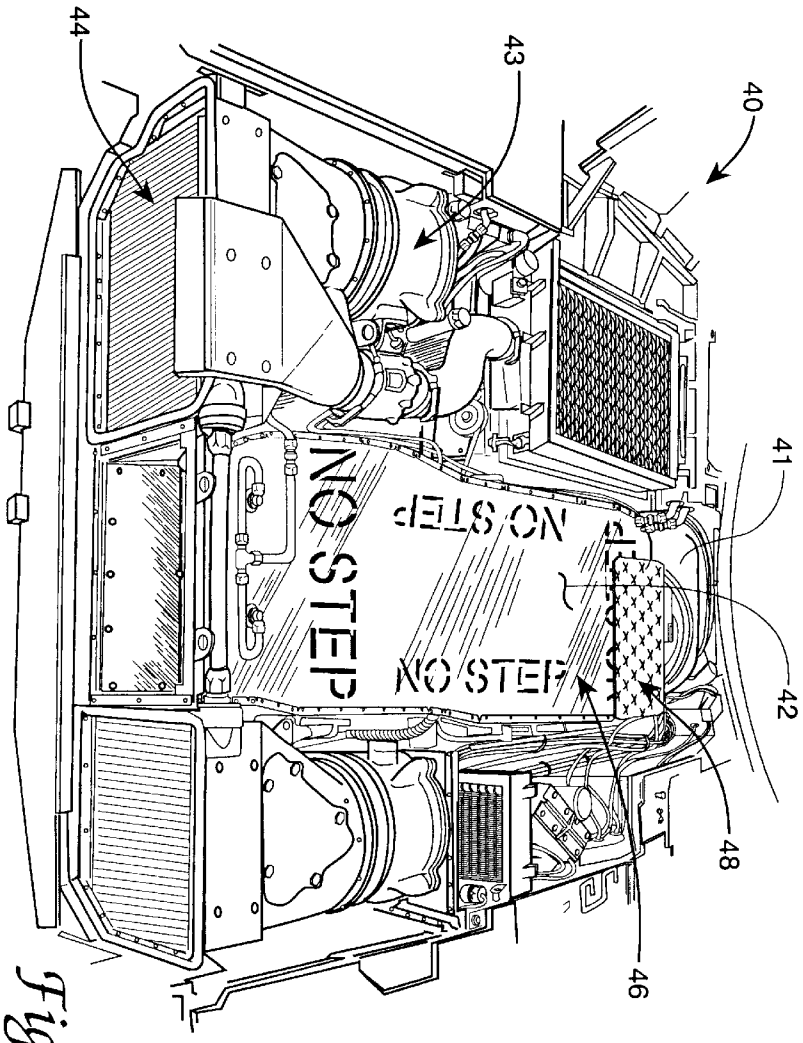
FIG. 2 shows a schematic perspective view of an AGT 1500 engine which was modified in demonstration of the invention.

FIG. 2 shows a schematic perspective view of an M-1 tank AGT 1500 engine 40 assembly (powerpack) which was modified in demonstration of the invention. Engine 40 accepts air at air inlet duct 41 and after combustion in engine 40, the air flows through exhaust duct 42 (shown in partial cutaway) rearwardly of the vehicle. Engine exhaust 46 is disposed beneath exhaust duct 42. Two cooling fans 43 (one shown in FIG. 2) force air from a grille (not shown) above fan 43 past primary oil cooler 44 and rearwardly of the vehicle. An engine fire within engine 40 normally occurs at location 48 as a result of fuel line leakage in a region in the forward section of engine 40. Outside ventilation air passing location 48 may provide sufficient oxygen to maintain a fire indefinitely.

Figure 2A:
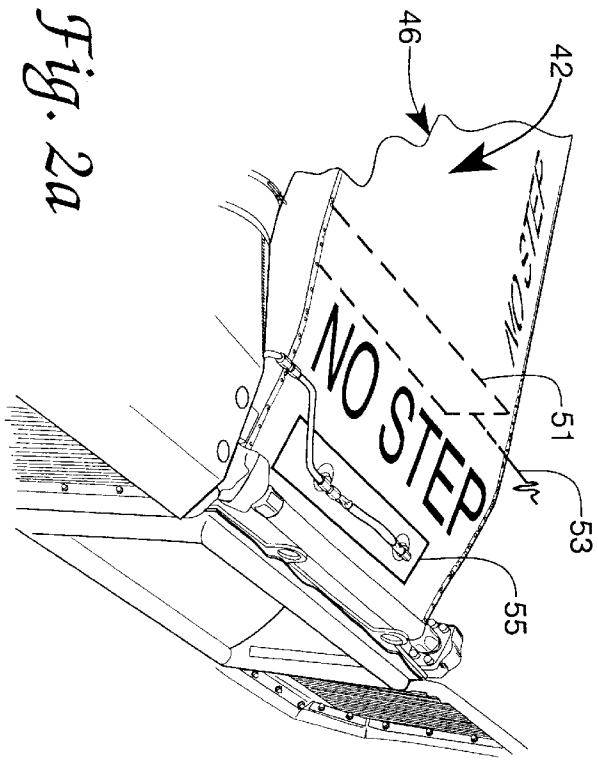
FIG. 2*a* is a perspective top view of a portion of the engine of FIG. 2.

Referring now to FIG. 2*a*, shown therein is a top perspective view of a portion of engine 40 including exhaust duct 42. In a preferred embodiment requiring minimum modification to engine 40, flap 51 is installed within exhaust duct 42 just downstream of engine exhaust 46, which can shut off flow of exhaust air down exhaust duct 42. Flap 51 may be controlled by mechanical linkage 53 attached to a controller (e.g. 26 in FIG. 1). Vent flap 55 is spring-loaded and opens automatically with the slight buildup of pressure to release the exhaust air over engine 40. The exhaust air will be eventually exhausted out cooling fans 43, and may run continuously in this configuration.

A critical consideration in successfully practicing the invention is whether sufficient exhaust gases are generated which, when redirected over engine 11, reduce the effective oxygen concentration within engine compartment 13 below the 15 vol % level that will not effectively support combustion. In the example of the AGT-1500 engine considered in demonstration of the invention, a total of about 21,000 cfm (cubic feet/minute) of ventilation air (78 vol % nitrogen, 21 vol % oxygen) is circulated through the engine compartment. About 10,000 cfm of exhaust gas is exhausted from the engine during operation. If all the exhaust volumetric gas flow rate $V_X$ is directed to the engine 20 compartment and is mixed with the ventilation airflow rate, then an oxygen volumetric flow rate $V_O$ in the total flow V through the engine compartment will be approximated by:

$$V_O=(V-V_X)21/(21+78)$$

and, in the example of the AGT-1500 engine, $$V_O=(21{,}000-10{,}000)21/99=2{,}333 \text{ cfm}$$

which results in an effective oxygen concentration of about 11.1% of the total flow V through the engine compartment, which is well below the threshold to support combustion. If the ventilation fan flow rate/pressure drop specifications are such that the mass flow rate V increases up to 31,000 cfm because of the addition of the exhaust gas, the maximum oxygen concentration will be about 14.37%, which is also sufficient for extinguishment.

Another critical consideration is the quantity of asphyxiating gases such as carbon monoxide (CO) which might leak into the crew/passenger compartment adjoining the engine compartment. In the AGT-1500 engine example, a CO concentration of approximately 0.43 parts per hundred (pph) is generated in $V_X$. Because the exhaust is mixed with ventilation airflow to produce V, the CO concentration $V_{CO}$ in V may be approximated by:

$$V_{CO}=0.43\ (V_X/V)$$

and for the flows assumed above, $V_{CO}$=0.43(10,000/21,000) =0.2 pph (2000 ppm) in the flow within the engine compartment. In the M-1 engine compartment application just described, it has been determined that gases in the engine compartment do not enter the passenger compartment (USAACSTA Report No 97-CC-119 (Feb 1997)). In the event, however, that in some applications limited leakage may occur into the occupied area adjacent the machinery space, a leakage of up to 1.5% into the occupied space of equivalent volume of the machinery space (more if the occupied space in proportionally larger) is acceptable in terms of extended exposure to carbon monoxide. A carbon monoxide concentration of 35 ppm is tolerable for human exposure up to about 10 hours (National Institute of Occupational Safety and Health Standard, U.S. Department of Health and Human Services, 1994 *Pocket Guide To Chemical Standards*).

The invention therefore provides a fire suppression system for the engine compartment of a vehicle. It is understood that modifications to the invention may be made as might occur to one with skill in the field of the invention within the scope of the appended claims. All embodiments contemplated hereunder which achieve the objects of the invention have therefore not been shown in complete detail. Other embodiments may be developed without departing from the spirit of the invention or from the scope of the appended claims.

I claim:

1. A fire suppression system for the engine compartment of a vehicle having an engine including an exhaust duct, said fire suppression system comprising:

(a) a remotely controllable throttle valve disposed within the exhaust duct of an engine for selectively diverting exhaust gases from said exhaust duct; and (b) a bypass duct operatively connected to said throttle valve for conducting said exhaust gases forwardly of said engine for mixing with the ventilation airflow across said engine and reducing the oxygen content in the airflow over said engine below a level which will effectively support combustion.

2. The system of claim 1 wherein said throttle valve comprises a controllable damper or a butterfly valve.

3. The system of claim 2 further comprising a controller operatively connected to said throttle valve by mechanical or electromechanical linkage for remote operation of said throttle valve.

* * * * *